United States Patent [19]

Pollock

[11] Patent Number: 4,509,401

[45] Date of Patent: Apr. 9, 1985

[54] PORTABLE AMMUNITION HANDLING AND LOADING SYSTEM

[75] Inventor: Stephen F. Pollock, Tallahassee, Fla.

[73] Assignee: Wayne H. Coloney Company, Inc., Tallahassee, Fla.

[21] Appl. No.: 624,807

[22] Filed: Jun. 27, 1984

Related U.S. Application Data

[63] Continuation of Ser. No. 563,885, Dec. 28, 1983, abandoned, which is a continuation of Ser. No. 376,044, May 7, 1982, abandoned.

[51] Int. Cl.[3] ..... F42B 39/12

[52] U.S. Cl. ..... 86/48; 89/34

[58] Field of Search ..... 89/33, 14, 34; 86/48

[56] References Cited

U.S. PATENT DOCUMENTS

| | | | |
|---|---|---|---|
| 2,413,316 | 12/1946 | Freeman | 86/48 |
| 2,432,398 | 12/1947 | Edson et al. | 86/48 |
| 2,638,029 | 5/1953 | Boehmer | 86/48 |
| 4,137,820 | 2/1979 | Clemens | 89/34 |
| 4,281,583 | 8/1981 | Pollock et al. | 89/33 BB |

*Primary Examiner*—Stephen C. Bentley

*Attorney, Agent, or Firm*—Dowell & Dowell

[57] ABSTRACT

A manually portable ammunition handling and loading system for delivering live rounds of large caliber ammunition from an ammunition supply belt to an automatic weapons system such as those carried by military aircraft, and which simultaneously collects expended shell casings and unfired rounds from the weapons system. The portable loading system is selectively mounted on an ammunition supply container and a spent round collection container and serves to feed belt carried ammunition from the supply container to the weapons system and to discharge the same belt carrying shell casings and unfired rounds received from the weapons system into the collection container.

12 Claims, 14 Drawing Figures

PORTABLE AMMUNITION HANDLING AND LOADING SYSTEM

This application is a continuation of application Ser. No. 563,885, filed 12/28/83, now abandoned, which is a continuation of Ser. No. 376,044 filed 5/7/82, now abandoned.

BACKGROUND OF THE INVENTION

1. Field of the Invention

This invention relates generally to systems for loading ammunition into automatic weapons systems and relates particularly to a portable handling and loading system for delivering large caliber ammunition to military aircraft and the like.

2. Description of the Prior Art

There has been a great deal of recent effort directed to alleviating the problems encountered in replenishing ammunition used in rapid fire military aircraft weapons systems. In today's weapons system having firing rates which may approximate 4,200 rounds a minute, it is necessary that a substantial number of rounds be carried by the aircraft. In order to reduce the time required to load the armament systems on an aircraft, ammunition handling systems having been developed during the past few years which enable such armament systems to be loaded in rates in excess of 600 to 700 rounds a minute.

In applicant's prior U.S. Pat. No. 4,281,583 a trailer mounted ammunition supply system is disclosed which is capable of delivering 20 mm to 40 mm ammunition to an aircraft armament system at high rates of speed. The system of applicant's prior invention not only supplied ammunition to the armament system, but provided for the collection of the spent shell casings and misfired rounds being off loaded from the armament system. In the use of applicant's prior invention, a ground vehicle maneuvers the loader which weighs in excess of 1½ tons to an area adjacent the aircraft being loaded. A first section of flexible chuting is extended between the ammunition supply container and the loader, and a second elongated flexible chuting is connected between the loader and the aircraft armament system. Due to the size of the loading system it is frequently necessary to use lengths of flexible chuting of 20′ to 30′ in order to connect the loader with the aircraft being serviced.

It has been determined that the current ammunition supply systems are not adequately suited for uses in all situations, as such systems not only are large and bulky in themselves, but that the amount of flexible chuting required to connect such systems to sources to ammunition supply and to the armament system being serviced, present additional handling problems. In addition to the foregoing, such loading systems can only be operated using power sources which are capable of driving relatively large feed drums to deliver rounds to, and to draw spent rounds from, the armament system.

In addition to applicant's prior U.S. Pat. No. 4,281,583, U.S. Pat. No. 4,137,821 to Clemens discloses another design for an automatic ammunition supply systems.

SUMMARY OF THE INVENTION

The present invention is embodied in a portable and manually maneuverable apparatus for supplying large caliber ammunition to an armament system while simultaneously removing shells and misfired rounds therefrom. The apparatus may be selectively mounted directly on the ammunition supply containers without excess conveyor chuting and includes a drum for receiving a series of interconnected or belted tubular members in which the ammunition is initially stored. As the tubular members are carried around the drum the ammunition is removed axially of the tubes by shuttles movable along the face of the drum and parallel with the axis thereof. As the rounds are completely removed from the tubular members they are transferred through a gun loading interface to a relatively short length of flexible chuting which interconnects the apparatus with the armament system interface. Spent rounds from the armament system are simultaneously collected by the shuttles at the gun loading interface and such spent rounds are thereafter inserted into the empty tubular members which are being carried about the surface of the drum.

After the spent rounds have been returned to the tubular members of the supply belt, the belt is removed from the drum and guided through a fixed discharge chute which extends remotely from the drum. As the supply belt passes through the fixed chute it is shifted longitudinally relative to the drum so as to be aligned with an ammunition collection container positioned adjacent to the ammunition supply container.

The loading system may be manually powered by hand cranking and is limited in this capacity only by the amount of power necessary to drive the armament system to which the loader will be drivingly interconnected. In addition to the foregoing, the loader is so designed that when mounted to a standard ammunition supply container, the loader and container will generally not exceed a combined height of 4′ and thus the loader and supply container may be positioned juxtaposed relationship to conventional aircraft armament systems.

It is the primary purpose of this invention to provide a portable automatic loading system for use in conveying large caliber ammunition to military aircraft weapons systems and the like which may be easily carried and manually maneuvered by two military personnel in the field and which may be directly mounted on the ammunition supply containers during use.

It is another object of this invention to provide an ammunition loader which when mounted to a standard ammunition container does not exceed a height greater then the minimum height clearance associated with present military aircraft and thus permits the supply container with the apparatus mounted thereon to be disposed directly adjacent the aircraft's ammunition supply interface. Due to the proximity of the loader to the aircraft only a minimal length of flexible conveyor chuting is required between the loader and the aircraft ammunition supply interface.

It is a further object of this invention to provide an ammunition loading system which may be used to feed 20 mm to 40 mm ammunition to the armament systems of military aircraft at feed rates of between 600 to 700 rounds per minute.

It is an additional object of the present invention to provide a high-speed loading system for large caliber ammunition in which fresh rounds of ammunition are removed from an ammunition supply belt and thereafter spent rounds supplied to the ammunition supply belt. The ammunition supply belt is subsequently reoriented longitudinally of the apparatus to permit subsequent delivery and storage in an awaiting collection container.

It is another object of this invention to provide a loading system in which the ammunition carried through the loader is cammed and shuttled from the supply belt while the supply belt traverses a generally straight circular path about the transfer drum with the supply belt being subsequently reoriented lengthwise of the drum through fixed discharge chuting which extends remotely of the drum.

It is yet another object of the invention to provide a loading system for large caliber ammunition which is quickly and easily connected to the armament system being supplied by way of a short and lightweight length of flexible conveyer chuting.

DESCRIPTION OF THE PREFERRED EMBODIMENT

Figure 1:
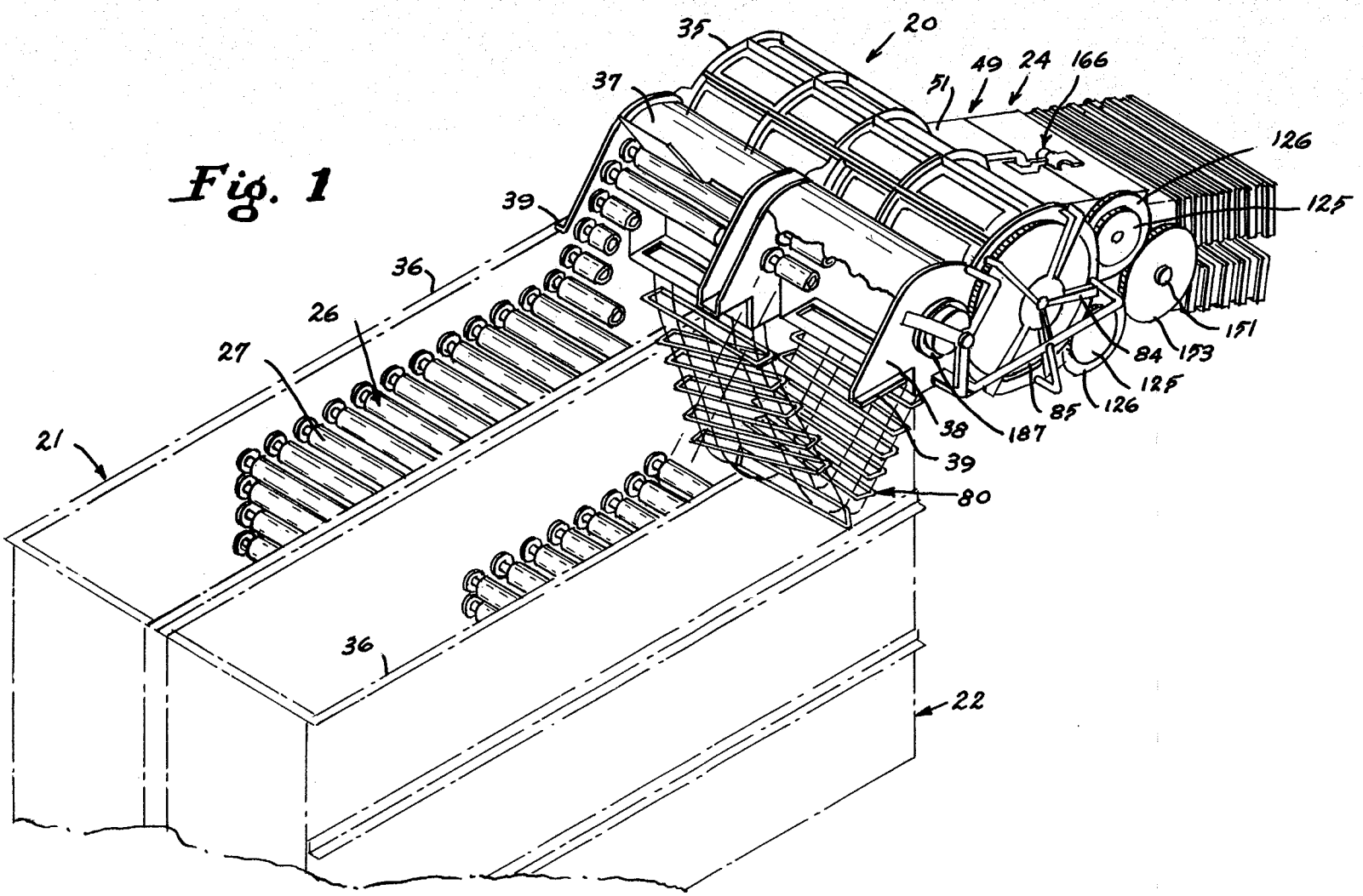
FIG. 1 is a perspective view illustrating one embodiment of the invention as it is mounted to a pair of conventional ammunition storage containers.

With continued reference to the drawings, the portable ammunition handler and loader 20 is shown as being mounted on a pair of conventional ammunition storage containers 21 and 22 and operates to supply rounds of ammunition to and receive unfired or misfired rounds and empty shell casings being discharged from the ammunition storage pod 23 of an aircraft or other weapons system. The actual transfer of ammunition and shell casings between the ammunition pod 23 and the loader 20 is accomplished by way of a flexible conveyor chute assembly 24 in a manner as will be described in greater detail hereinafter.

The container 21 is the ammunition supply container and when filled, serves to house an elongated supply belt 26 of the type generally disclosed in applicant's prior U.S. Pat. No. 4,281,583. Such supply belts include a plurality of tubular container members 27 of a size to receive a round of ammunition of a predetermined caliber such a 20 mm, 30 mm, or 40 mm. The tubular container members are connected by flexible generally nonstretchable material loops 28 so that the center to center spacing of each of the tubular containers may vary within certain limits when such loops are slack; additionally the tubular members may be shifted or moved a limited amount in axial relationship to the adjacent tubular members for purposes as will be elaborated on further in greater detail. In addition to serving as supply containers for new rounds of ammunition 30, the tubular members of the supply belt are utilized to receive shell casings, unfired and misfired rounds of ammunition 31 being off loaded from the weapon system being serviced. The container 22 will initially be an empty container and will serve as a collection receptacle for storing the ammunition belt after the belt has passed through the loader and exchanged new rounds of ammunition 30 for shell casings or nonfired rounds 31.

Each tubular member or ammunition tube 27 is generally cylindrical having an open end 32 and closed end 33. A relatively large annular groove 34 is provided around the tubular member adjacent the closed end thereof. The annular groove will be used to guide the tubes 27 as they pass through the loader.

The ammunition loader 20 includes a generally cylindrical drum housing 35 which is selectively mounted to the upper edge portions or walls 36 of the ammunition containers 21 and 22 by supply and discharge hoods 37 and 38. With specific reference to FIGS. 2 and 3 it is noted that each of the hoods include outstanding flange members 39 which rest upon the upper walls 36 of the containers 21 and 22 and a depending flange portion 40 that serves to abut the inner front wall 42 of the respective ammunition containers 21 and 22. In order to stabilize the loader when it is mounted to the ammunition supply and collection containers a pair of generally parallel support struts 43 are connected to the drum housing 35 and extended downwardly into engagement with a supporting surface S. The struts serve to support the loader against any downward pivotal movement with respect to the supply and collection containers. A pair of generally parallel and horizontally disposed container abutting members 44 are fixedly connected on the lower portion of the support struts and extend inwardly into intimate engagement with the outer forward wall 45 of the supply and collection containers when the loader is mounted to such containers so as to further brace the loader in its mounted position.

Figure 2:
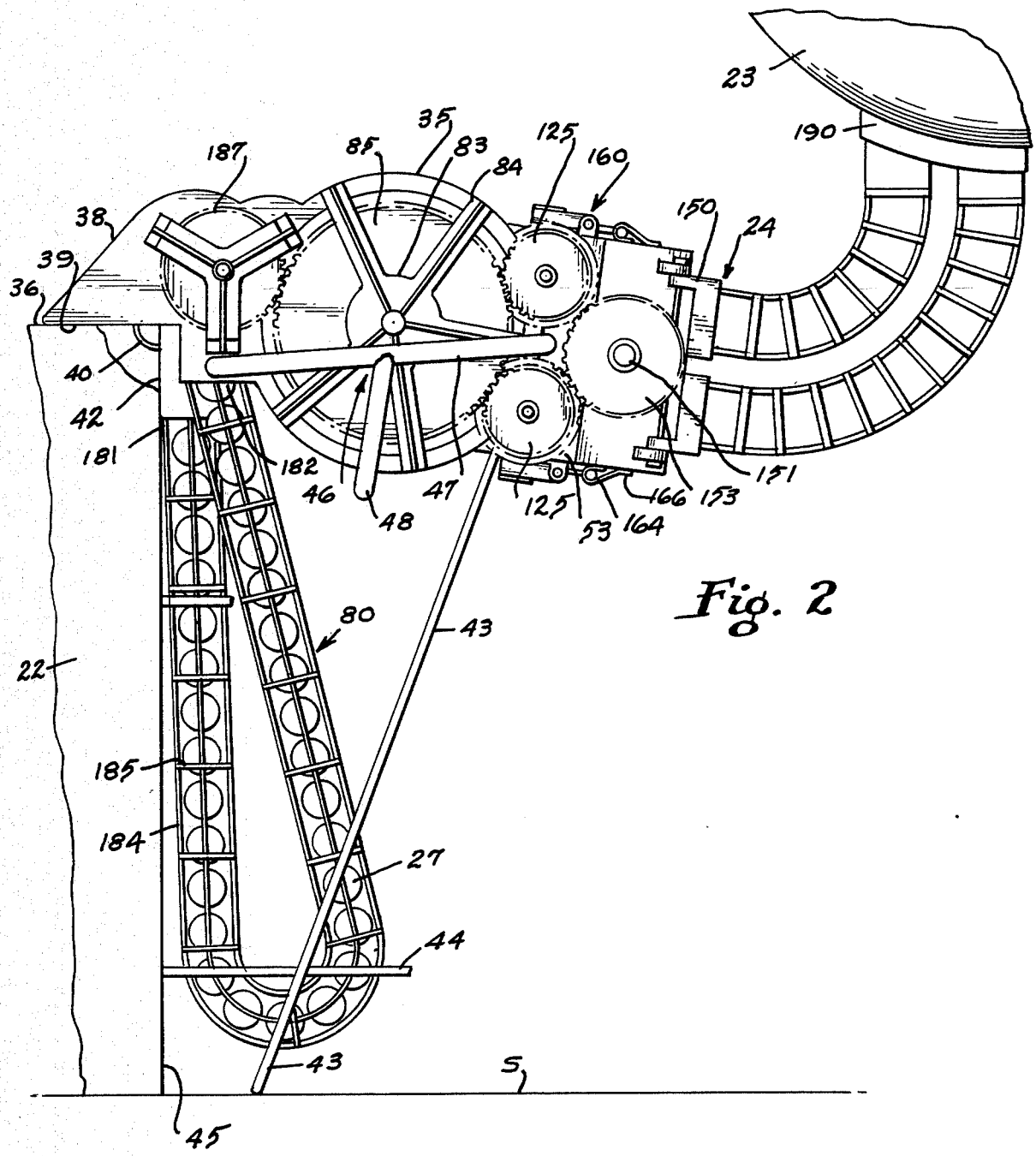
FIG. 2 is a side elevational view of the loader shown in FIG. 1.

As the ammunition supply loader of the present invention is designed and constructed to be maneuvered by not more than two support personnel in the field, a carrying handle assembly 46, FIG. 2, is connected to each end of the drum housing. Each handle assembly include a general horizontal carrying bar 47 and one or more vertically disposed reinforcing bars 48 which connect the central portion of the carrying bar to the lower portion of the drum housing. In addition to the foregoing, the loader includes a forward or gun interface housing 49 which extends outwardly from the drum housing remote from the supply containers. The gun interface housing includes upper and lower surfaces 51 and 52 and side walls 53 and 54.

Figure 5:
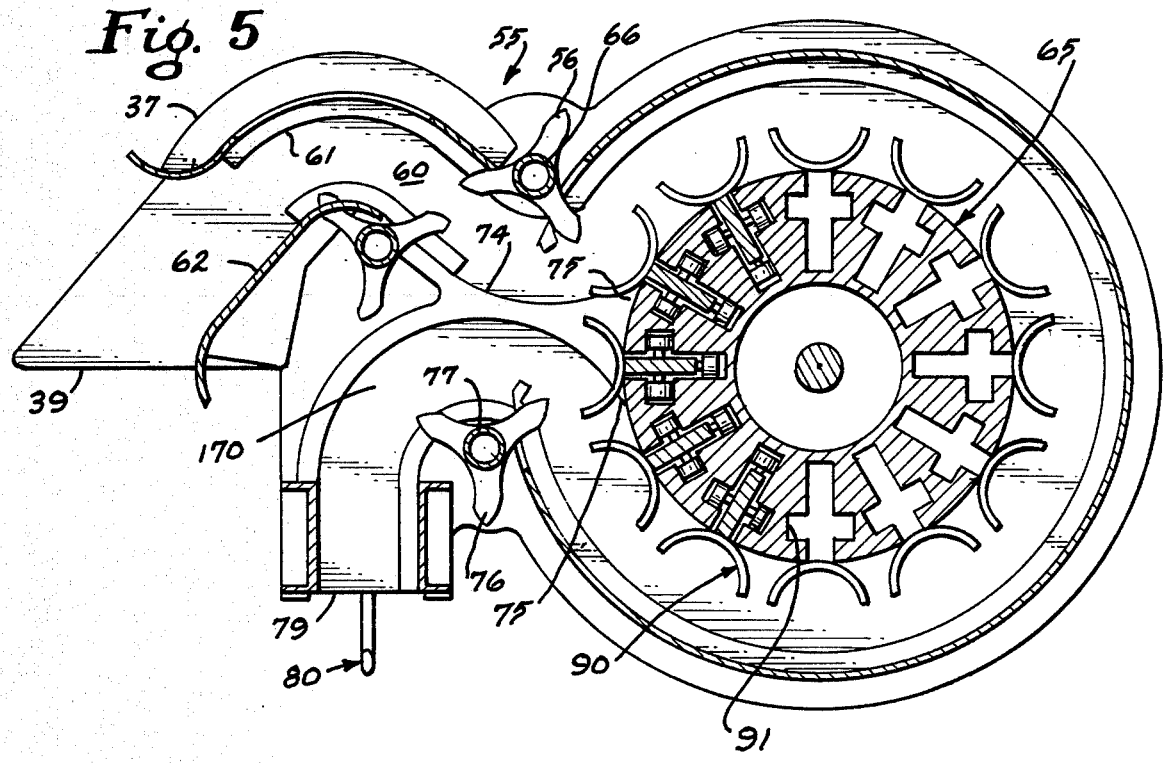
FIG. 5 is an enlarged section view taken along line 5—5 of FIG. 3.

In order to pull or feed the ammunition belt 26 from the supply container 21, the loader includes a supply container interface unit 55, FIG. 5, disposed within the supply hood or housing 37. The supply container interface unit 55 includes two pair of guide star wheels or sprockets 56 and 57. Guide sprockets 56 serve to initially engage the tubular members 27 of the supply belt and pull the belt out of the supply container and through the guide channel 60 defined by upper and lower arcuate wall portions 61 and 62 of the supply container interface. Guide sprockets 57 serve to engage the tubular members and place the tubes on the main ammunition transfer drum 65.

Figure 3:
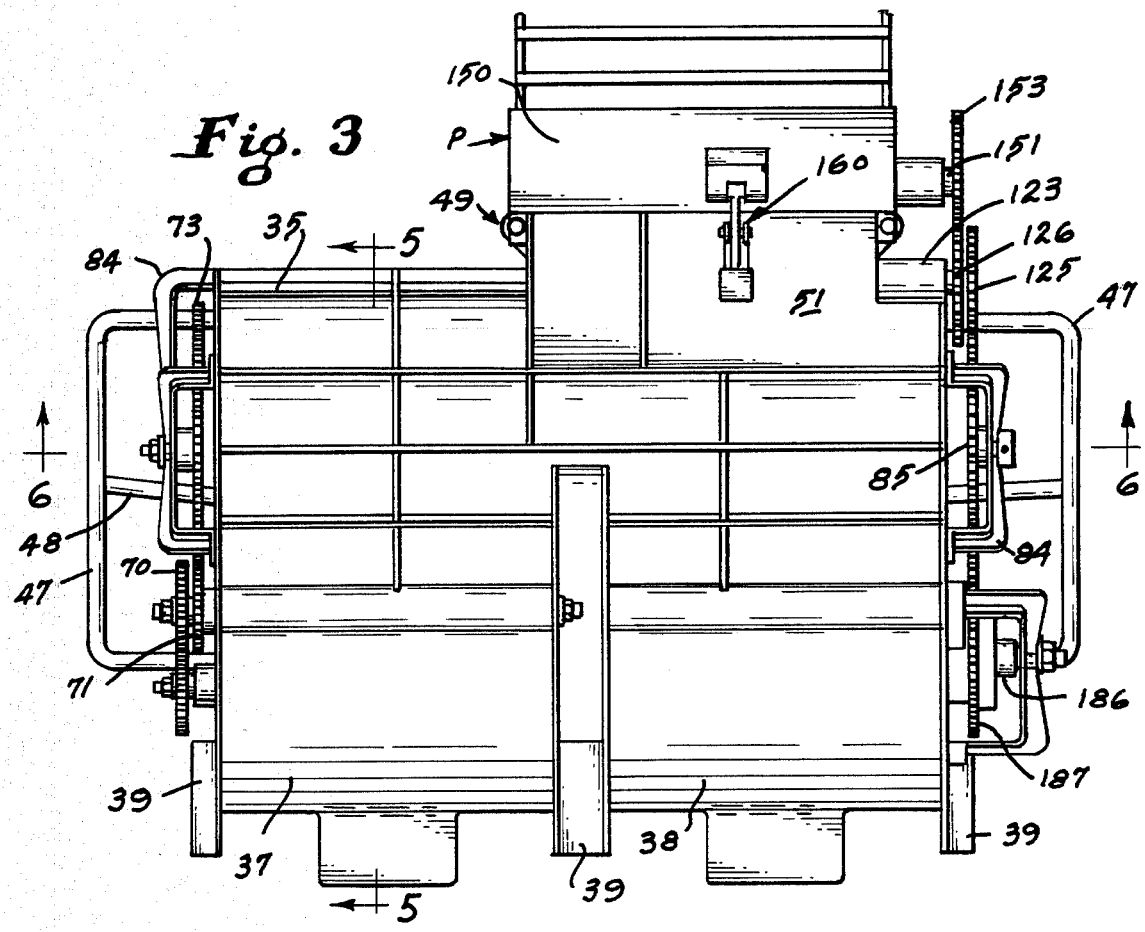
FIG. 3 is a top plane view of the loader shown in FIG. 1.

The guide wheels 56 and 57 are mounted on drive shafts 66 and 67 respectively, and are oppositely driven in timed relationship to one another through interconnecting spur gears 70 and 71 which are mounted to the drive shafts 66 and 67, respectively, adjacent one side of the supply hood 37 shown in FIG. 3. A smaller spur gear 72 is mounted on drive shaft 66 and is driven by a large main spur gear 73 as will be described in greater detail hereinafter.

Proper alignment of the tubular members of the supply belt with the transfer drum 65 is insured by a pair of spaced Y-shaped and an elongated guide elements 74 which extend inwardly of the drum housing and flare outwardly at their innermost ends 75 into substantial peripheral alignment with the surface of the main ammunition transfer drum 65 as shown in FIG. 5. One of the guide elements will engage the recessed end of the tubular members and the other guide element will engage a portion of the tubular members spaced from the recessed portion. Thereby, the guide elements will support and positively position the ammunition tubes with respect to the drum as the supply belt passes through the supply interface unit 55.

Spaced immediately below the guide sprockets 56 are a pair of spaced pickoff sprockets 76. The pickoff sprockets are mounted on a drive shaft 77 having a spur gear 78 mounted thereon which gear is driven by the large spur gear 73 associated with the drum. The pickoff sprockets 76 engage the tubular members of the ammunition belt after the belt has traveled about the drum and urges the tubular members towards the discharge opening 79 in the drum housing and downwardly into a fixed reorientation or discharge chute 80. It should be noted that the guide elements 75 initially lift the tubular members from the drum and thereafter guide the ammunition belt towards the discharge chute.

Figure 6:
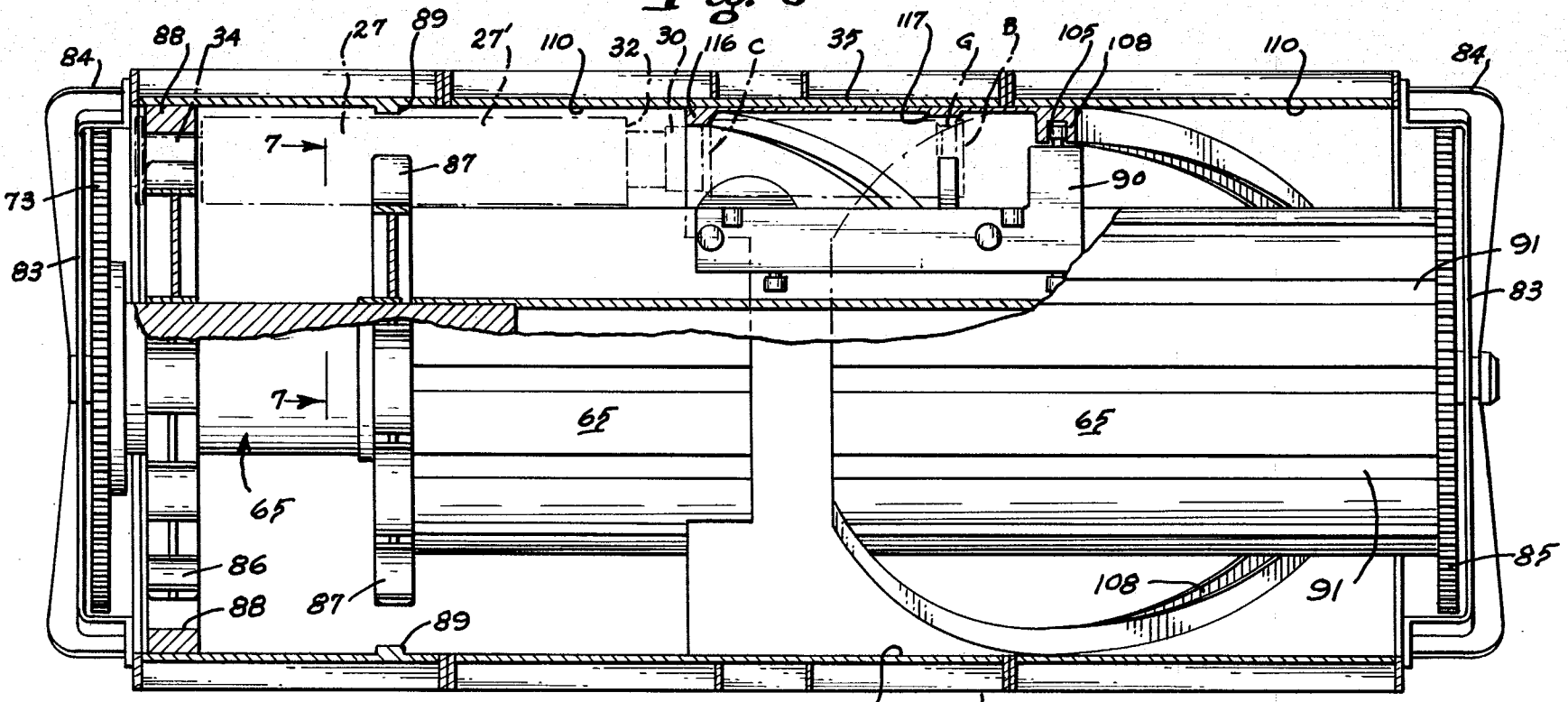
FIG. 6 is an enlarged sectional view taken along line 6—6 of FIG. 3 with portions broken away.
Figure 7:
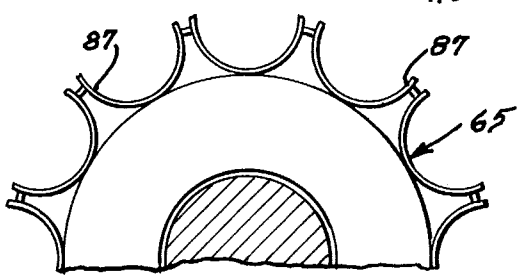
FIG. 7 is a sectional view taken along lines 7—7 of FIG. 6.
Figure 8:
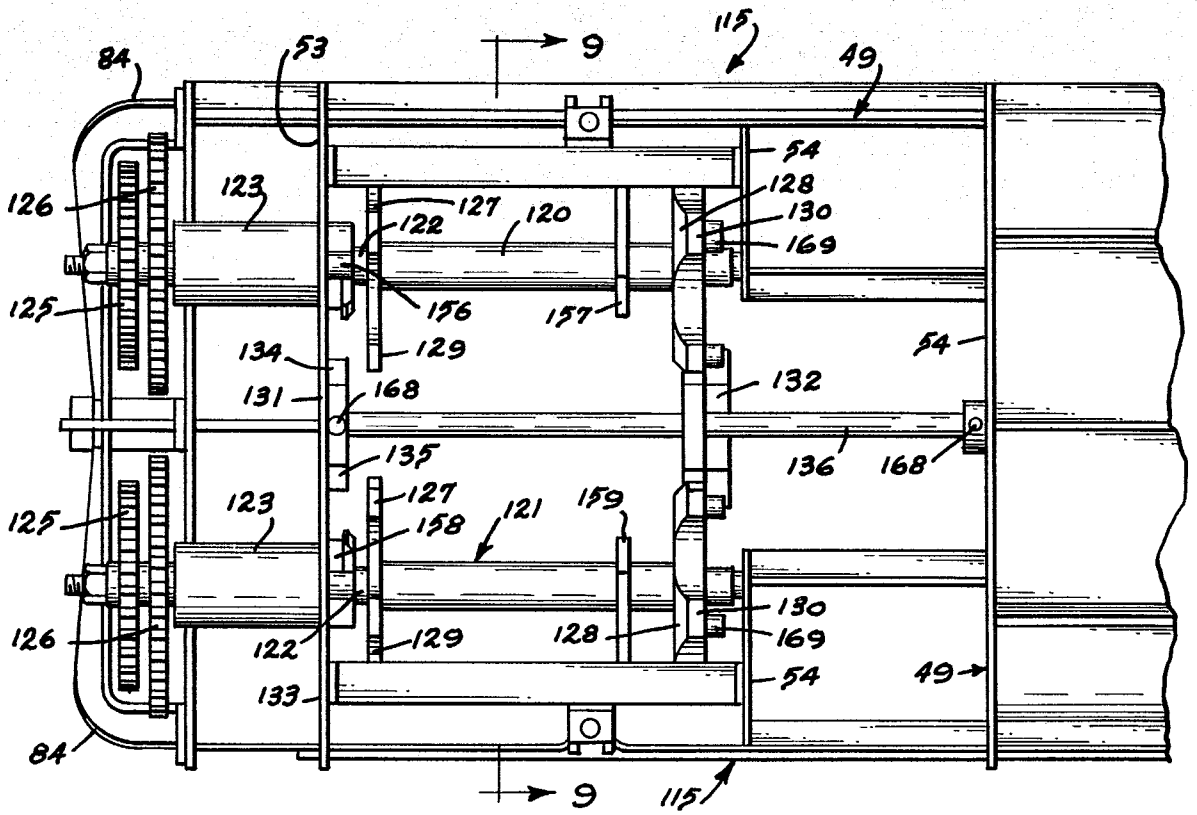
FIG. 8 is an enlarged partial front view of the ammunition loader shown in FIG. 1 showing the forward interface unit.

With particular reference to FIGS. 6 through 8, the ammunition transfer drum 65 includes a main drive shaft 82 which is disposed axially of the drum and is carried at each end thereof within bearings mounted in end plates 83 which are supported by a plurality of reinforcing frame members 84. The large spur gear 73 is secured to the main drive shaft 82 adjacent one end of the drum housing and a second large spur gear 85 is secured to the opposite end of the main drive shaft 82.

A plurality of first and second cradle members 86 and 87 are fixed to the transfer drum 65 so as to be forwardly aligned with the supply container interface 55. The cradle members are spaced along the periphery of the drum so that the center to center distance therebetween as shown in FIG. 7 is substantially identical to the center to center distance between the generally tubular members 27 of the supply belt which members are being introduced to the cradle members by the guide wheels 56 and guide element 74. The cradle members 86 and 87 are mounted to the drum so as to be spaced in axially alignment with one another. The cradle members 87 will support the central portion 27' of the ammunition tubes while cradle members 86 will engage the reduced annular grooved portions 34 of the ammunition tubes. As the cradle members 86 engage the reduced annular portions of the ammunition tubes at a point inwardly from the outermost wall portions of the tubes, the cradle members 86 will prevent lengthwise movement of the ammunition tubes with respect to the drum.

In order to further guide the ammunition belt as the belt is carried around the drum 65, a pair of annular guide flanges 88 and 89 are provided which extend interiorly of the drum housing toward the surface of the drum. The annular guide flange 88 serves to guide the reduced annular groove portion of the tubular members of the ammunition belt while the annular guide flange 89 engages the outer wall of the ammunition tube at a point along its length. From the foregoing and with particular reference to FIG. 6, the ammunition tubes of the supply belt are positively retained on the drum during their travel through the loader by the cooperative restraining characteristics of the cradles 86 and 87 and the outer guide flanges 88 and 89 on the drum housing.

In applicant's prior U.S. Pat. No. 4,281,583 the ammunition supply belt is cammed away from the ammunition being carried thereby as the belt is transported around the loading drum. As noted in that patent, the rounds of ammunition and shells traveled in a straight path while the container belt moved in a serpentined path about the drum. However, such movement of the ammunition belt is not possible in the portable loading system of the present invention as the diameter of the drum is not large enough to permit the ammunition belt to be shifted along the drum a sufficient distance during each half revolution to totally separate the tubular members from the rounds of ammunition. In applicant's prior patent, the ammunition belt was cammed away from the rounds of ammunition at an angle of approximately 21° on a drum having a diameter of approximately 2'. With the portable unit of the present invention, the rounds of ammunition must be cammed away at an angle of approximately 51° on a drum having a diameter of approximately 18". As the amount of longitudinal movement of an ammunition tube relative to an adjacent tube is limited by the ammunition belt loops 28, it is not possible to cam the belt from the ammunition at relative large cam angles. Therefore, the belt must follow a generally circular path about the drum and the ammunition, returning shells and unfired rounds must be moved longitudinally of the drum to be cooperatively oriented with respect to the ammunition belt.

With particular reference to FIGS. 6 and 10–12, the axial movement of the ammunition and shells relative to the ammunition belt is accomplished using a plurality of shuttles 90 which travel in T-shaped guide channels 91 provided in the drum. As noted in the drawings, the guide channels extend approximately three-quarters of the length of the drum so as to permit the ammunition transfer shuttles 90 to be moved from adjacent the open end 32 of the ammunition tubes of the supply belt toward the remote end of the drum.

Each shuttle member 90 is generally L-shaped and includes a generally rectangular body 92 having upper and lower surfaces 93 and 94, side walls 95 and 96, and an upstanding tail portion 97 which extends outwardly beyond the body to an uppermost portion 98. An enlarged generally U-shaped saddle member 99 is attached to the body 92 of the shuttle adjacent the front or nose portion 100 thereof. Spaced between the saddle members 99 and the tail portion 97 of the shuttle is an extractor cradle 101 which is similar in U-shaped configuration to the saddle member.

Figure 10:
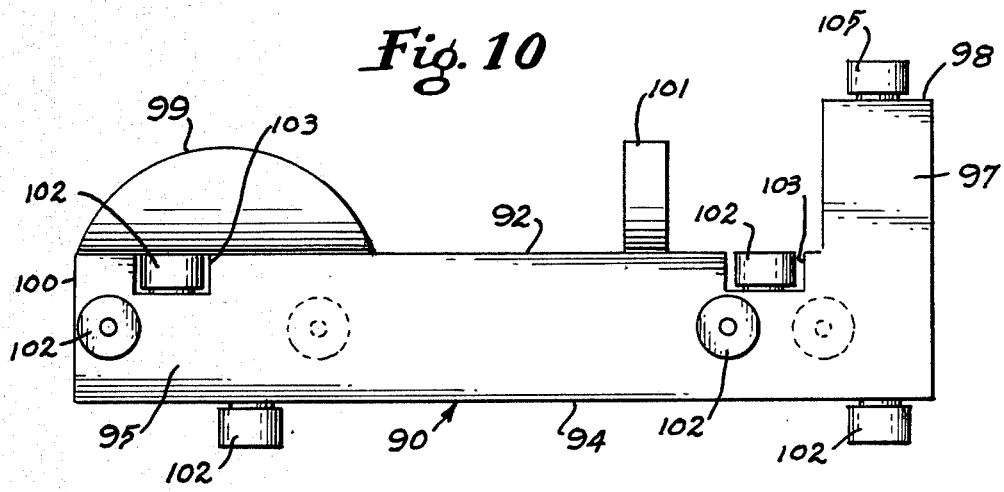
FIG. 10 is a side elevational view of a drum shuttle.
Figure 11:
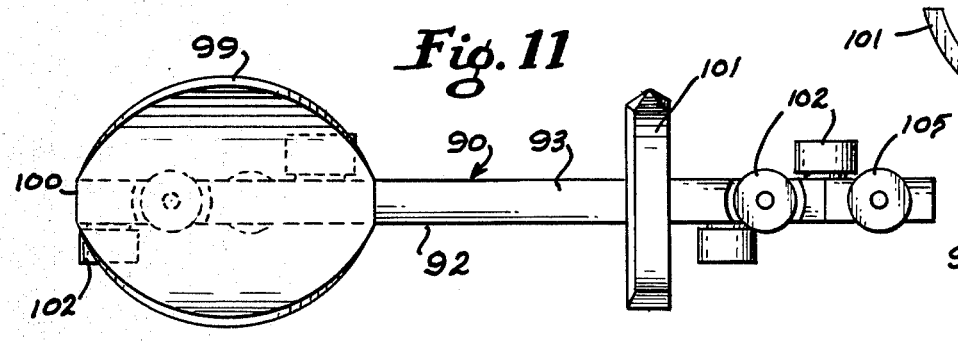
FIG. 11 is a top plan view of the drum shuttle of FIG. 10.
Figure 12:
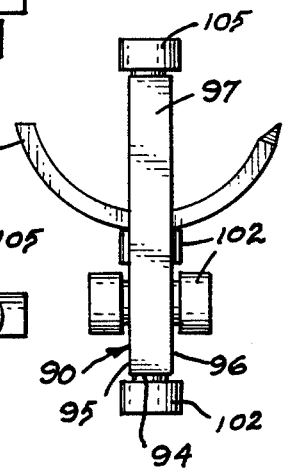
FIG. 12 is an end view of the drum shuttle of FIG. 10.

Each shuttle is provided with a plurality of freely rotating followers 102 which function to permit the shuttle to be easily moved along the T-shaped channels of the drum. Two such followers are attached in spaced relationship to the lower surface and side walls of shuttle as shown in FIGS. 10–12, and two additional followers are provided in slots 103 in the upper surfaces of the shuttle. The followers 102 provide positive guidance for each shuttle within the T-shaped channels 91, as shown in FIG. 5.

Longitudinal movement of each shuttle relative to the drum is accomplished by means of a tracking follower 105 mounted to the upper portion 98 of the tail 97 of each shuttle. Such followers 105 travel in and are guided by a continuous U-shaped helical track 108 which is disposed completely around and extends inwardly of the inner surfaces 110 of the drum housing 35. In this manner, as the drum is rotated within the stationary housing, the tracking followers 105 will be guided along the helical guide track 108 causing the shuttle to be shifted longitudinally with regard to the axis drum in the T-shaped guide channels 91. The helical track 108 includes generally straight portions which define the end limits of travel for the shuttles and which serve to maintain the shuttles in fixed relationship to the drum during a portion of the drums revolution in order to permit the transfer of incoming ammunition or shell casings and nonfired rounds between the shuttles and the ammunition supply tubes 27 and the shuttles and the front or gun interface 115 as will be described hereinafter in greater detail.

With particular reference to FIG. 6, as the shuttles are urged toward the ammunition supply tubes the saddle members 99 will pass just below the tubes while the pickoff cradle 101 of each shuttle will engage the groove G adjacent the butt end portion B of the incoming round of ammunition 30. Thereafter, the shuttle will be guided axially of the supply tube 27 as the cam follower 105 of the shuttle rides within the helical track 108. In this manner the incoming round of ammunition will be urged from the supply tubes of the ammunition belt with the shoulder portion C of such rounds being supported by the saddle portion 99 of the shuttle. As previously discussed, due to the relatively large caming angle, the incoming round of ammunition will be totally removed from its associated supply tube during less then one-half revolution of the drum and will thereafter be brought into alignment with the gun or forward interface of the loader 115.

In order to further stabilize the ammunition or shell casings being transported from the supply tubes by the shuttles, a pair of spaced helical guide flanges 116 and 117 are disposed about the inner periphery 110 of the drum housing 35 and extended inwardly therefrom toward the shuttle members 90. The first guide flange member 116 will engage the shoulder portion of a round of ammunition being carried by a shuttle while the second flange member 117 will engage the butt end portion of the round. In this manner the rounds of ammunition or shells being transferred by the shuttle are engaged between the saddle 99 and cradle members 101 of the shuttle 90 and the guide flanges 116 and 117 of the drum housing and will thereby be maintained in an axial alignment with the supply tubes from which such rounds are being extracted or to which returning rounds or shells will be conveyed.

Figure 9:
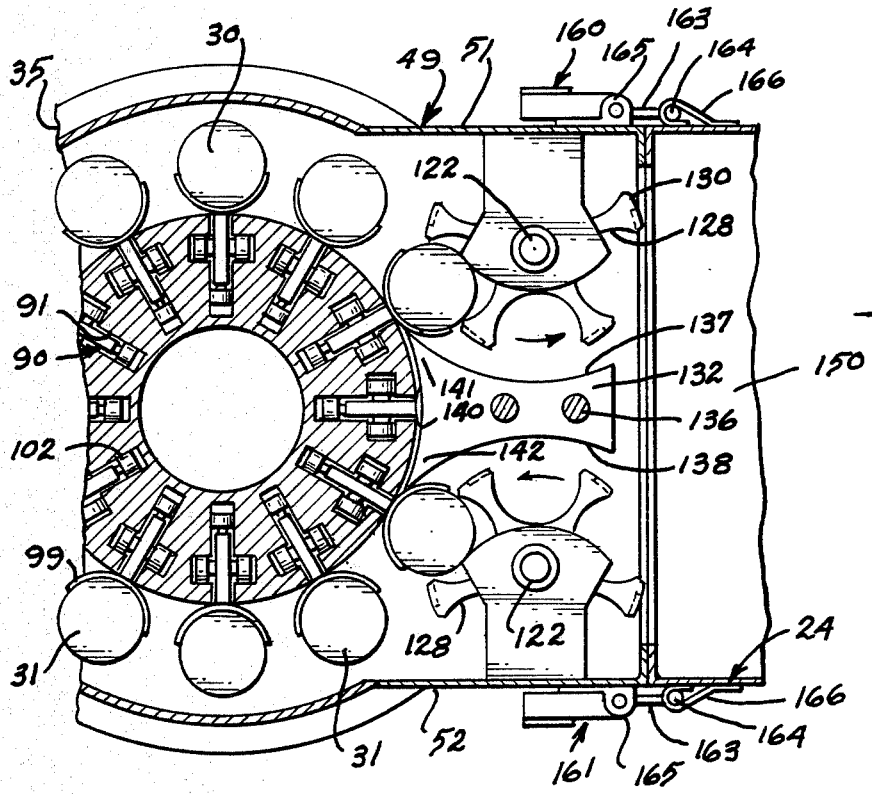
FIG. 9 is an enlarged partial sectional view taken along lines 9—9 of FIG. 8.

With respect to FIGS. 8 and 9 the forward or gun interface 115 of the loader is shown in greater detail. At the gun interface, incoming rounds 30 are removed from the shuttles as such shuttles are brought into alignment therewith as the drum revolves as shown by the arrow in FIG. 9. After an incoming round of ammunition has been removed from a shuttle, such shuttle is free to accept returning shells or unfired rounds being conveyed into the forward interface from the gun conveyor chute assembly 24.

The gun interface 115 includes a pair of generally parallel transfer sprocket assemblies 120 and 121 which are mounted within the gun interface housing 49. The sprocket assembly 120 transfers rounds of ammunition from the drum shuttle to the gun conveyor chute assembly 24 while sprocket assembly 121 receives spent shell casings and unfired rounds being returned to the loader from the armament system and transfers the same to the drum shuttles. Each transfer sprocket assembly includes a drive shaft 122 mounted adjacent one end through bearings 123 which extend through the side wall 53 of the gun interface housing 49 and at the other end in bearings 124 provided in the opposite side wall 54 of the gun interface housing. A driving spur gear 125 and a driven spur gear 126 are secured to the drive shafts externally of the side wall 53 of the gun interface housing and cooperate to rotate the drive shafts in timed relationship to the drum and the main power drive of the ammunition transfer conveyor chute assembly 24 as will be described hereinafter in greater detail.

Each drive shaft 122 of the forward or gun transfer sprocket assemblies carries a pair of spaced pickoff star wheels or sprockets 127 and 128. The pickoff sprockets 127 include a plurality of teeth 129 which engage a round of ammunition carried by the proximately disposed drum shuttle 90 adjacent the butt end B thereof while the teeth 130 of the pickoff sprockets 128 simultaneously engage the round of ammunition adjacent the shoulder or crimped portion C thereof.

Mounted adjacent to each of the sprocket assemblies 120 and 121 are a pair of fixed guide members 131 and 132. The guide members 131 are shown in FIG. 8 as being attached to the inner wall 133 of the side wall 53 of the gun interface housing 49 and include an upper generally concave shaped guiding surface 134 and a lower generally concave guiding surface 135 which guide surfaces are oppositely oriented with respect to one another. One or more mounting bars 136 extend between the side walls 53 and 54 of the gun interface housing 49 and support the second fixed guide member 132. The second fixed guide member also provides an upper concavely shaped guide surface 137 and a lower oppositely oriented arcuate guiding surface 138.

With particular reference to FIG. 9, each of the fixed guide members 131 and 132 includes a generally Y-shaped end portion 140 which is disposed adjacent to the periphery of the drum and has a first portion 141 which extends upwardly relative to the drum, and a second portion 142 which extends downwardly relative to the drum. In view of the foregoing, as the rounds of ammunition are conveyed towards the sprocket assembly 120 such rounds will be guided from their seated position on the drum shuttles by the fixed guide members 131 and 132 and urged into the pockets of grooves formed between the teeth in the upper pickoff sprockets 127 and 128. Thereafter the teeth of the upper pickoff sprockets will urge the round of ammunition along the upper guide portions 134 and 137 of the fixed guide members 131 and 132, respectively, towards the rear interface 150 of the gun conveyor chute assembly 24.

The rear interface of the conveyor chute gun assembly includes a pair of spaced sprocket members (not shown) mounted on the primary ammunition supply drive shaft 151 which is extended through the rear interface housing 152 of the conveyor chute assembly. The primary drive shaft includes a drive gear 153 which is mounted exterior of one side wall of the housing and a drive socket or connection that is provided on the opposite side of the drive shaft as is generally located as shown in FIG. 3 at P. Ordinarily, the drive socket 154 will be connected to a suitable power source (not shown) such as one extended from the armament system being supplied so that the main drive shaft may be driven at a rate which coincides with the drive rates of the ammunition storage system of the armament system.

As shown in FIG. 3 the drive gear 153 mounted to the main power shaft 151 will engage the driven gears 126 mounted to the drive shafts 122 of the gun interface sprocket assemblies 120 and 121. The drive gears 125 carried on the outer portion of the drive shafts 122 of the gun interface sprocket assemblies will mesh with the main drum gear 85 which gear will rotate the main drum drive shaft 82 and the oppositely disposed drum spur gears 73. The spur gears 73 will in turn be meshed with the spur gears 72 and 78 of the sprockets 56 and 76 of the supply interface unit 55. In this manner the rotation of the sprockets of the loader and the rotation of the drum are maintained in timed relationship with the feed of ammunition or shells coming from the armament system by way of the gun conveyor chute assembly 24.

With particular reference to FIG. 9, as the spent shell casings or unfired rounds of ammunitions are returned through the conveyor chute assembly 24 such shells or rounds are engaged by the lower pickoff sprockets 127 and 128 and are urged against the lower guide surfaces 135 and 138 of the fixed guide members 131 and 132.

In addition to the fixed guide members 131 and 132, the gun interface also includes a pair of upper arcuately shaped guide flanges 156 and 157, and a pair of lower arcuately shaped guide flanges 158 and 159. The guide flanges 156 and 158 are mounted to the inner side wall 133 of the housing 49 in vertically spaced relationship with the upper and lower surfaces 134 and 135, respectively, of the fixed guide member 131. The guide flanges 157 and 159 extend from the upper and lower walls 51 and 52 of the housing 49 and are in spaced vertical relation with the upper and lower surfaces 137 and 138 of fixed guide member 132, respectively. The upper guide flanges 156 and 157 and upper surfaces 134 and 137 of the guide members 131 and 132 create a fixed guide channel through which incoming rounds of ammunition 30 are conveyed. In a like manner the lower guide flanges 158 and 159 are mounted to cooperate with the inner guide surfaces 135 and 138 of the guide members 131 and 132 and form guide channels for receiving and conveying shell casings or unfired rounds of ammunition 31 being off-loaded from the armament or weapons system.

The gun conveyor chute assembly 24 is mounted to the housing 49 of the gun interface unit by upper and lower locking bar assemblies 160 and 161 which are secured to the upper and lower surfaces 51 and 52 of the gun interface housing. Each locking bar assembly includes a locking bar 163 having an enlarged head portion 164. The locking bars are pivotably mounted with respect to the the housing 49 by mounting brackets 164. A pair of locking bar retainers 166 are attached to the upper and lower surfaces of the housing 150 of the gun conveyor chute assembly and selectively receive the enlarged head portions 164 of the locking bars. To further facilitate the alignment and attachment of the gun conveyor chute assembly to the gun interface housing, a pair of guide pins (not shown) extend from the gun conveyor housing 150 and are selectively received within openings 168 in the gun interface housing.

As the crimped or shoulder portions of the rounds of ammunition vary somewhat in dimension based upon the origin of manufacture and as the shoulder portion of the ammunition has a tendency to drop vertically relative to the shuttles as such rounds approach the gun interface, the teeth 130 of the upper and lower pickoff sprockets 128 are formed having substantially L-shaped portions 169. The L-shaped portions of the teeth extend parallel to the drive shafts 122 and provide enlarged surface engaging portions which initially contact the shoulder portion of the round or shell being conveyed through the gun interface and thereby compensate for any variance in the size or dimension of the shoulder of the round being conveyed. In a like manner and for like purpose, the inner portion 140 of the fixed guide member 132 is of a greater width then the adjacent fixed guide member 131.

After the unfired ammunition or spent shell casings returning from the weapon systems have been placed on the shuttle members the continued rotation of the drum about its axis will cause such shuttles to be moved horizontally relative to the aligned tubular members of the supply belt. As the drum revolves approximately 130°, the returned rounds or shell casings are fully received within the tubular members. Thereafter, the ammunition belt is introduced into the lower portion of the rear or discharge interface 170 where it is engaged by the end 75 of the pickoff guide element 74 and the pickoff sprockets 76. The pick-off sprockets 76 engage the ammunition belt and urge the same through the discharge chute 79 and into a fixed reorienting guide chute 80. As the ammunition belt has not been laterally displaced relative to the ammunition supply container 21 as it travels about the transfer drum, it is necessary that the ammunition belt be reoriented lengthwise of the drum so as to be properly aligned for depositing in the collection container 22.

Figure 4:
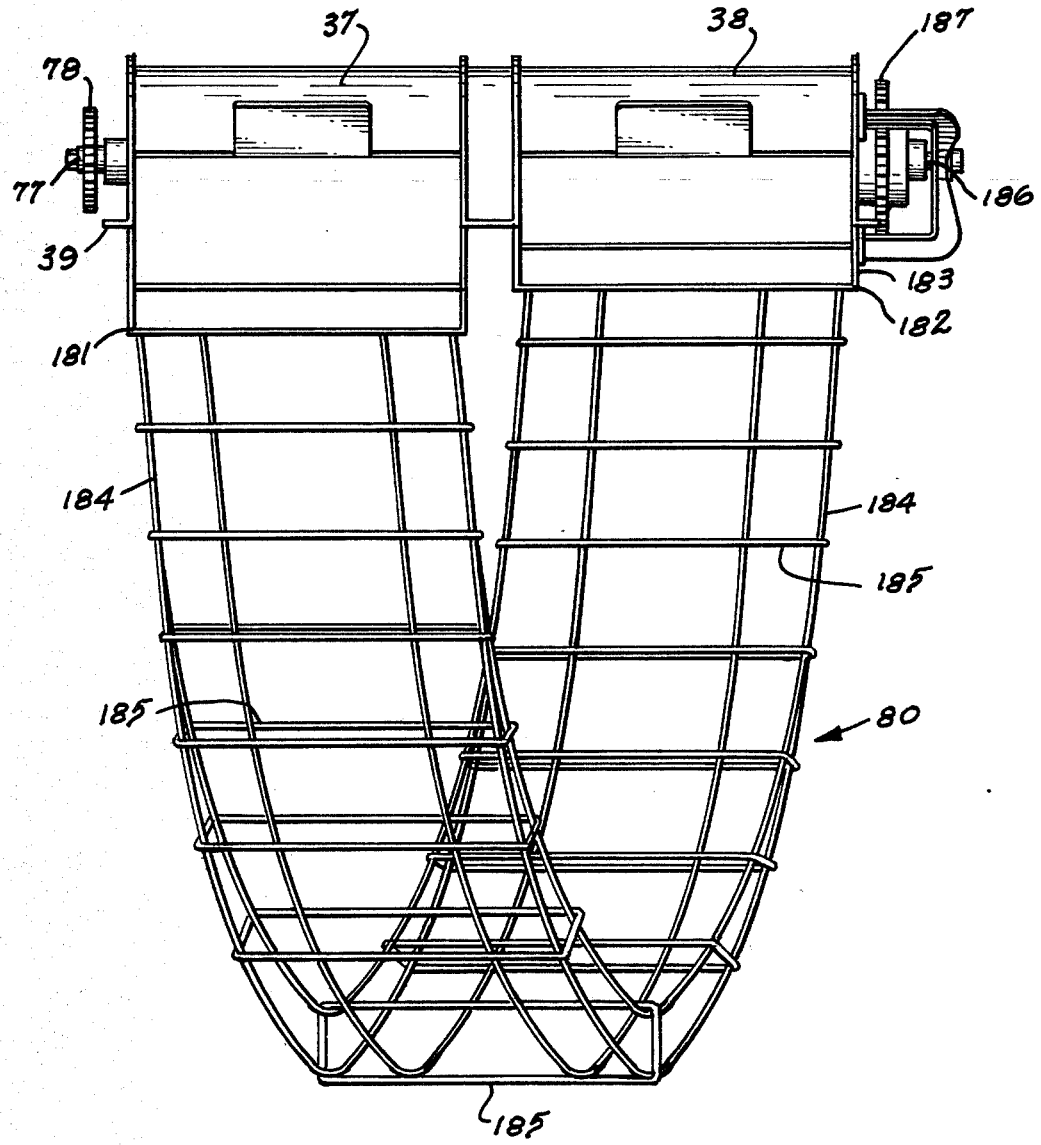
FIG. 4 is an enlarged rear elevational view of the fixed reorientation chute shown in FIG. 2.

With particular references to FIGS. 2 and 4, as the ammunition belt passes from the discharge openings 79, it is guided through the reorientation chute vertically downwardly relative to, and simultaneously shifted longitudinally of, the drum. The fixed reorientation chute 80 includes a receiving portion 181 mounted adjacent to the loader discharge chute opening and an end on discharge portion 182 which is mounted to the lower portion 183 of an ammunition discharge hood 38. The receiving and discharge portions of the reorientation chute are longitudinally spaced from each other relative to the drum so that the receiving portion is generally aligned with the ammunition supply container 21 which the discharge end thereof is generally aligned with the receiving container 22. The reorientation chute extends downwardly and upwardly in generally a U-shaped configuration, and includes a plurality of generally parallel spaced elongated U-shaped guide rods 184 which are joined in fixed relationship by a plurality of reinforcing crossbars 185.

As the ammunition belt passes through the reorientation chute the tubular members thereof are shifted longitudinally so as to be brought into alignment with the receiving container 22. A pair of discharge sprocket members (not shown) are mounted on a drive shaft 186 disposed through the discharge hood 38. The discharge sprockets are driven by spur gear 187 which is powered by engagement with the main spur gear 85 of the drum. The discharge sprockets engage the tubular members traveling upwardly along the reorientation chute and guide the ammunition belt down to the receiving receptacle 22 as shown in FIG. 1.

The loader of the present invention is designed to permit efficient on and off loading of large caliber ammunition relative to an armament system such as a rapid fire weapons system utilized on military aircraft. In the event it becomes necessary to resupply ammunition to an aircraft, the loader may be easily hand carried and located immediately adjacent the aircraft by two support personnel and mounted directly on standard supply and storage containers as shown in FIG. 1. The weight of prototype loaders is only slightly greater than 200 pounds and it is contemplated that production models constructed of lightweight metals will weigh less than 150 pounds. The total height of the loader above the ground surface when mounted to the containers is such that the unit may be placed directly beneath an ammunition supply pod such as shown in FIG. 1. This alleviates the need for elongated conveyors between the loader and the supply container as well as between the loader and the aircraft as is necessary with current loading systems.

With the present invention, after the loader is mounted on the supply and storage containers, the gun conveyor chute assembly 24 is attached by way of the quick release lock assemblies to the gun interface housing 49 and the remote end 190 of the conveyor assembly is secured to the armament system interface or pod 23. An end of the ammunition container belt from the supply container 21 is introduced into the supply interface 55 of the loader and power is applied to the main drive shaft of the gun conveyor assembly 24. The ammunition belt is subsequently drawn through the supply interface and guided to the transfer drum by the sprocket assemblies 56 and 57. After the ammunition belt is seated on the drum, the shuttles 90 will engage the groove in the butt portion of the rounds housed within the ammunition tubes and urge the rounds from the tubes during the first approximately 130° of revolution of the drum.

Figures 13, 14:
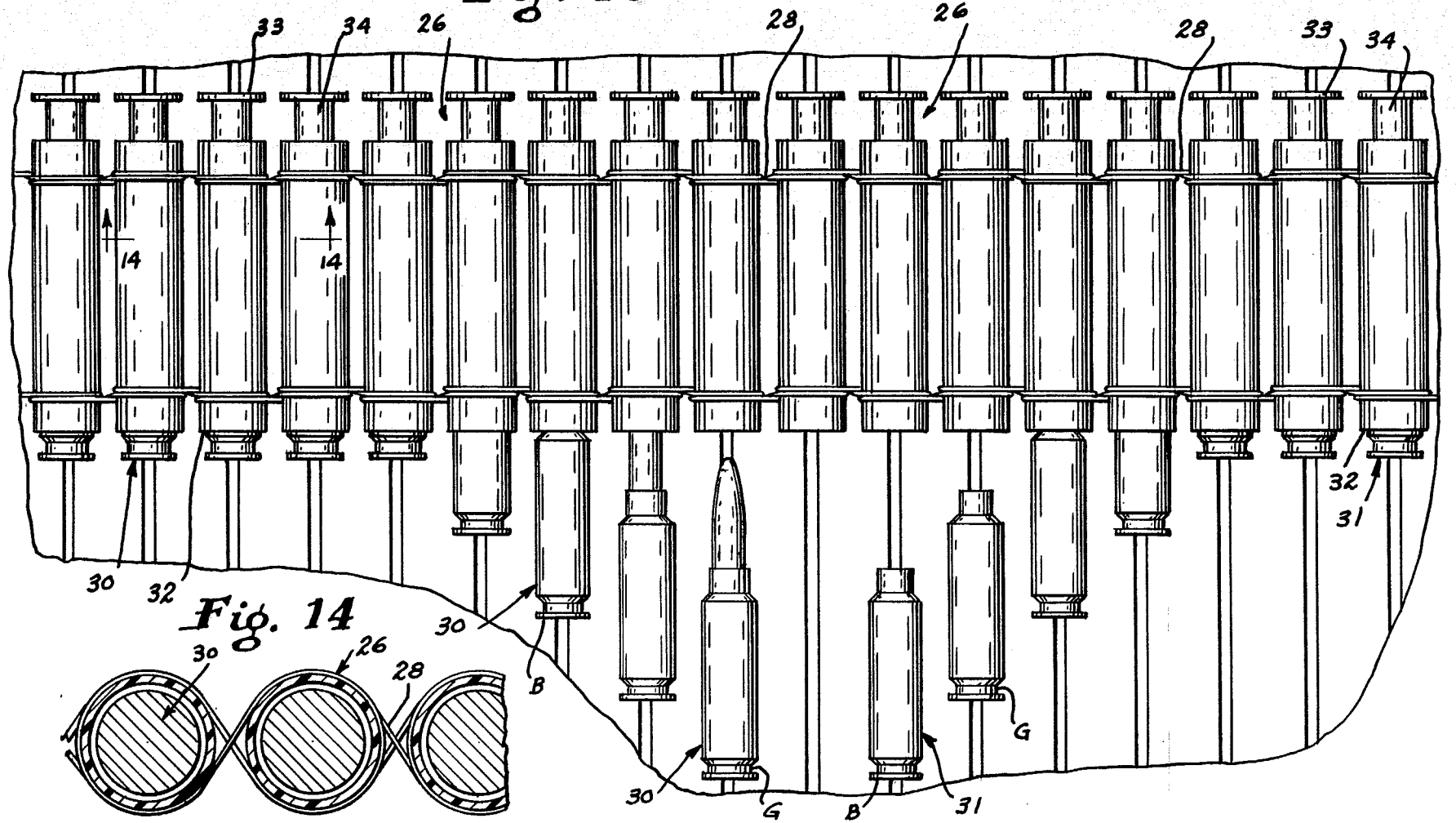
FIG. 13 is a schematic view illustrating the layout of the drum.
FIG. 14 is a sectional view taken along lines 14—14 of FIG. 13.

The rounds of ammunition which have been removed from the supply belt and are being conveyed by the shuttles, are subsequently engaged and/or guided by the pickoff sprocket assembly 120 and fixed guide members 131 and 132, and 156 and 157 of the gun interface unit 115 and are thereby transferred to the weapons system by way of the flexible conveyor chute assembly 24. Simultaneously, shell casings and unfired rounds of ammunition being off loaded from the weapons system are transferred from the flexible conveyor chute assembly through the gun interface by action of the sprocket assembly 121 and fixed guide members 131, 132 and 150 and 159 to the awaiting shuttles. Continued movement of the drum causes the shuttle members to be urged toward the empty tubular members of the ammunition belt as shown in layout form in FIG. 13 and thereby the unfired ammunition or casings are placed in such tubular members. The supply belt continues to be carried about the drum until the tubular members are engaged by pickoff sprockets 76 and fixed guide member 75 of the discharge interface 170 which urge the ammunition belt through the discharge chute downwardly into the reorientation chute 80. As the ammunition belt passes through the reorientation chute, it is shifted longitudinally with respect to the transfer drum so as to become aligned with the collection container 126. Thereafter, the ammunition belt is disposited into the collection container.

As previously discussed, the loader of the present invention may, alternatively, be powered by use of hand crank which could be selectively connected to the main power shaft 151 of the gun conveyor chute assembly 24 one of the drive shafts of the loader. However, hand cranking of the loader may not be possible if the amount of power necessary to drive the conveyor system of the armament system exceeds the amount of power practically developable using a hand crank.

I claim:

1. An apparatus for transferring large caliber ammunition stored in tubular members of an ammunition belt from a supply container to an armament system and simultaneously delivering shells and unfired rounds of ammunition from the armament system to a collection container comprising a housing, means for mounting said housing on the supply and collection containers, a drum means rotatably mounted within said housing, a plurality of fixed and radially spaced cradle members carried by said drum means adjacent one end thereof, a supply interface having conveying means to draw the ammunition belt from the supply container and guide the tubular members of the ammunition belt toward said fixed cradle members of said drum, a plurality of shuttle means carried by said drum means and being longitudinally movable relative thereto between said fixed cradle members and the opposite end of said drum means, each of said shuttle means having ammunition engaging and support means so that said shuttle means can engage a round of ammunition carried within the tubular members of the ammunition belt and transfer the same therefrom towards said opposite end of said drum means remote from the ammunition belt as said drum means is rotated, a gun interface adjacent said opposite end of said transfer drum, said gun interface having first and second transfer means, said first transfer means having means for engaging rounds of ammunition carried by said shuttles and for transferring said rounds to a conveyor means extending from adjacent said gun interface to the armament system, said second transfer means being vertically spaced from said first transfer means and having means for receiving shells and unfired rounds of ammunition passing from the armament system through the conveyor means and transferring such shells and unfired rounds to said shuttle means, a discharge interface remote from said gun interface and in vertically spaced relationship to said supply interface, a reorientation chute means extending from adjacent said discharge interface outwardly of said housing and longitudinally of said drum means, said discharge interface having means to guide the ammunition belt from said drum means into said reorientation chute means so that the ammunition belt is shifted longitudinally with respect to said drum means outwardly of said housing and guide means for guiding said ammunition belt from said reorientation chute means into the collection container.

2. The apparatus of claim 1 including first and second radially disposed rib means mounted to and extending inwardly of said housing and being in spaced relationship from said fixed cradle members of said drum means whereby the tubular members carried by said fixed cradle members are retained in generally nonshiftable alignment with respect to said drum means as said drum is rotated.

3. The apparatus in claim 1 including a helical track means disposed inwardly of said housing and extending a distance greater than half the length of said drum means, follower means mounted to each of said shuttle means, said follower means being received and guided within said helical track whereby said follower means causes said shuttle means to be longitudinally movable with respect to said drum means when said drum means is rotated.

4. The invention of claim 3 in which said drum means includes a plurality of elongated slots therein which extend generally parallel to the axis thereof and generally more than half the length of the drum means.

5. The invention in claim 4 in which each of said shuttle means includes guide means movable within said slot means to thereby guide said shuttle means with respect to said drum means.

6. The invention of claim 5 including first and second helical flange means carried by said housing and spaced from said track means toward said one end of said housing in vertically spaced relationship to said slots, said first flange means abutting the shoulder portion of the round of ammunition being transferred by said shuttle means and said second flange means abutting said round of ammunition carried by said shuttle means adjacent the butt end thereof.

7. The invention of claim 1 in which said first and second transfer means of said gun interface include at least first and second spaced sprocket means having a plurality of teeth and grooves, said teeth of said second sprocket means being substantially L-shaped so as to be oriented along the length of the drum means for engaging and supporting round of ammunition adjacent to shoulder portion thereof as said sprocket means are rotated.

8. The invention of claim 1 including a pair of oppositely disposed and outwardly extending handle members attached to, and extending from, said housing.

9. The invention of claim 1 including support strut means connected to said housing and extending downwardly therefrom adjacent to said reorientation chute and extending vertically below said reorientation chute to thereby support said housing relative to said supply and collection containers and to prevent said reorientation chute from supporting the weight of said housing.

10. The apparatus of claim 1 in which said means to draw the ammunition belt from the supply container said drum means and said first and second transfer means are drivingly interconnected to rotate in meshed relationship with one another.

11. A manually portable system for transferring large caliber ammunition stored in tubular members of an ammunition belt from a supply container to an armament system and simultaneously delivering shells and unfired rounds of ammunition from the armament system to a collection container comprising a housing, means for mounting said housing on the supply and collection containers, rotatable drum means mounted within said housing and having first and second ends, feed means for pulling the ammunition belt from the supply container and directing the belt to said first end of said drum means, means associated with said drum means for limiting the longitudinal movement of said ammunition belt relative to said drum means within said housing, transfer means carried by said drum means for extracting the ammunition from the tubular members and moving the ammunition longitudinally along and relative to said drum means toward said second end thereof as said drum is rotated, exchange means mounted adjacent to said second end of said drum means, conveyor means extending from said exchange means to the armament system, said exchange means having a first engaging means for removing rounds of ammunition being moved relative to said drum means adjacent said second end thereof and transferring the ammunition to said conveyor means and second engaging means for receiving shells and unfired rounds of ammunition from said conveyor means and transferring such shells and unfired ammunition to said transfer means of said drum, said transfer means conveying the shells and unfired rounds of ammunition into the tubular members of the ammunition belt, pickoff means mounted adjacent said drum means, guide means mounted exteriorally of said housing adjacent said pickoff means and extending longitudinally of said drum means, said pickoff means removing the ammunition belt from said drum means and introducing the ammunition belt to said guide means, and discharge means for discharging the ammunition belt from said guide means into the collection container.

12. The invention of claim 11 in which said guide means includes a first fixed guide chute portion extending vertically downwardly with respect to said drum means and a second fixed chute portion extending vertically upwardly toward said drum means whereby said guide means is substantially U-shaped in configuration.

* * * * *